US006340378B1

(12) United States Patent
Hinrichsen

(10) Patent No.: US 6,340,378 B1
(45) Date of Patent: Jan. 22, 2002

(54) METHOD FOR SCREENING HOT BRIQUETTED DIRECT REDUCED IRON

(75) Inventor: Jan D. Hinrichsen, Pittsburgh, PA (US)

(73) Assignee: Kvaerner Metals, Pittsburgh, PA (US)

( * ) Notice: Subject to any disclaimer, the term of this patent is extended or adjusted under 35 U.S.C. 154(b) by 0 days.

(21) Appl. No.: 09/382,878

(22) Filed: Aug. 25, 1999

(51) Int. Cl.[7] ..... C22B 1/24; C21B 13/00; B07B 13/05

(52) U.S. Cl. ..... 75/436; 75/770; 425/78; 209/665

(58) Field of Search ..... 75/436, 770; 266/130, 266/131, 132, 133; 209/665; 425/78; 110/186

(56) References Cited

U.S. PATENT DOCUMENTS 3,627,288 A * 12/1971 MacDonald
3,713,592 A * 1/1973 Beike
3,723,035 A * 3/1973 Franke
4,701,243 A * 10/1987 Lorenz et al. ..... 201/3
5,630,202 A * 5/1997 Bergendahl ..... 419/69
5,666,638 A * 9/1997 Bergendahl ..... 419/66

* cited by examiner

*Primary Examiner*—Roy King
*Assistant Examiner*—Harry D. Wilkins, III
(74) *Attorney, Agent, or Firm*—Armstrong, Westerman, Hattori, McLeland & Naughton, LLP

(57) ABSTRACT

A process and apparatus for separating briquettes and fragments in a product stream resulting from briquetting direct reduced iron. Separating and cooling of the briquettes and fragments are carried out simultaneously in an initial step with use of separating means submerged in a cooling bath. The process enables use of less rugged apparatus following the initial step and the apparatus is not subjected to handling the product stream at the elevated temperatures at which briquetting is carried out. Capital expenditure and equipment maintenance is thus reduced.

12 Claims, 1 Drawing Sheet

METHOD FOR SCREENING HOT BRIQUETTED DIRECT REDUCED IRON

BACKGROUND OF THE INVENTION

1. Field of The Invention

The present invention relates to a method for processing hot briquetted direct reduced iron (DRI) during a cooling and screening step of the briquetting process.

2. Description of Related Art

Direct reduced iron is produced by heating iron ore in a hot reducing gas atmosphere so as to strip oxygen from the ore to obtain iron-rich "sponge-iron". The sponge iron which maintains substantially the same shape as the iron ore processed, is relatively fragile and has a tendency to revert to the oxide state during storage. To facilitate handling, shipping and storage the sponge iron is formed into dense, often pillow shaped, briquettes referred to as "HBI" (hot briquetted iron).

The briquettes are most commonly formed by introducing the sponge iron, while still hot from the reducing gas processing step, between closely spaced cylindrical rolls having a series of opposed pockets in the cylindrical surfaces into which the sponge iron enters and is compacted to form the briquettes. The briquettes exit the rolls with a thin land between them resulting from a small spacing between the rolls. Following exit from the rolls, a breaker separates the connected briquettes. Such breaking step results in fragments of the briquettes being present which must be separated from the formed briquettes in a screening operation.

U.S. Pat. No. 4,236,699 describes a number of processes for treatment of the briquettes following exit from the briquetting press. In a process depicted in FIG. 3 briquettes along with fragments and fines are first cooled in a rotary cooler utilizing an inert gas and water. Following cooling of the briquettes, fragments and fines are screened to separate the various components. In processes depicted in other figures, the briquetting process receives already cooled metallized powder for forming briquettes.

U.S. Pat. No. 5,630,202 describes processes depicted in FIGS. 1 and 2 wherein, following briquetting between cylindrical rolls and separation of the resulting connected briquettes, the briquettes, fragments and fines are screened while still hot. The hot fragments and fines are recycled to the cylindrical rolls for compaction while the briquettes are conveyed to a cooling devise for cooling.

East Germany Patent No. 20,740 shows, in FIG. 3, screening lump shaped material in a still hot condition, then cooling oversized material in a water tank while conveying undersized material while still in the hot condition.

It is the object of the present invention to provide a method and apparatus to overcome problems associated with prior practice screening of hot briquetted iron.

SUMMARY OF THE INVENTION

The present invention provides a means to avoid the problems associated with conveying and screening hot briquetted iron while still at an elevated temperature. Hot screening and conveying of hot fines and briquettes while at a briquetting temperature between about 600 to 700° C. present severe demands on processing equipment. The present invention quenches the briquettes in an early step of the process so as to eliminate exposure of screening and conveying equipment to such harsh high-temperature processing conditions.

Both quenching and screening are carried out concurrently in a single operation wherein a robust coarse screen submersed in a water bath cools and separates the briquettes from the fragments. The briquettes, which form the larger portion of the material being processed and constitutes most of the weight, is conveyed across the screen and out of the bath to storage or shipment with little additional handling. Fragments, which pass through the screen, and which are a minor portion of the material being processed, can be further screened, to obtain an assortment of sizes for various markets, with use of less rugged screening equipment requiring less capital expenditure and reduced maintenance.

Specific features and contributions of the invention are described in more detail with reference being made to the accompanying drawing.

DETAILED DESCRIPTION OF THE INVENTION

Figure 1:
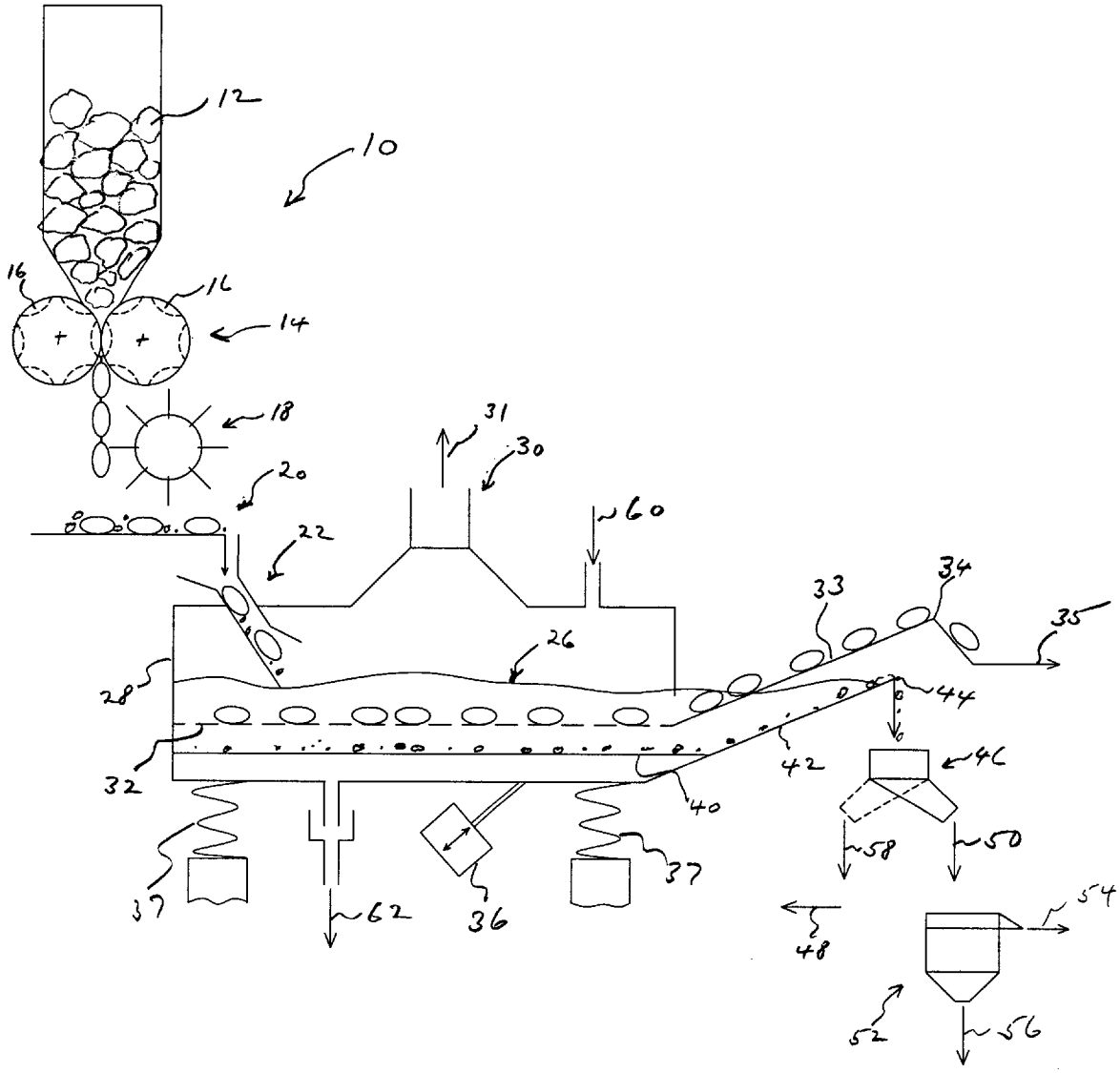
FIG. 1 is a schematic drawing of the process of the invention.

In FIG. 1, briquetting of direct reduced iron is carried out at briquetting apparatus 10. Hot direct reduced iron 12 is produced from iron ore pellets or lumps in a reactor (not shown) wherein a hot reducing gas removes oxygen from the ore. The resultant product consisting substantially of iron is spongy, relatively fragile, and has a tendency to revert to the oxide state during storage. Improved handling of product and reduction of oxidation are achieved by forming such material into the briquettes. Briquettes are formed by passing the still hot material between a pair of cylindrical rolls 14 having opposed pockets 16 so as to press and form the material into briquettes. Such briquettes typically have dimensions of about 1"×¼"×4", a weight of about 1 pound and a temperature in the range of about 600 to 700° C. A web or land can be present between the briquettes due to a gap between the cylindrical rolls. The connected briquettes are separated in the present embodiment as shown in FIG. 1 by string breaker 18. Fragments and fines from such forming and breaking operations are separated with use of the present invention so as to provide a uniform briquette product. In addition to separating the briquettes from the fragments and fines it is often necessary to further classify the fragments to satisfy different market segments. Such briquettes and fragments are depicted prior to screening at 20.

To minimize the difficulty of handling the briquettes and fragments while still at an elevated temperature, they are immediately quenched in a water bath with entry of such material stream at chute 22. It is an object of the invention to cool and remove the briquettes from the material stream as an initial step in the process since they make up the larger portion of the product stream and at such elevated temperature they are highly reactive and subject to oxidation. Removal at a first step enables use of less rugged processing apparatus for subsequent steps of the process. Additionally, with cooling also taking place in such first step, downstream equipment for handling both the briquettes and the fragments is subjected to significantly less wear with a lowered temperature work product.

Quenching water bath 26 is contained within enclosure 28 which can incorporate exhaust vent 30 for removing heat and moisture at 31. The material stream entering at 22 is first encountered by the bath and a submerged robust coarse screen 32 which can have screen openings in a range of about 18 mm by 18 mm to 22 mm by 22 mm. The briquettes are retained on the top surface of such screen and the fragments and fines, which are typically 30% or less of the material stream, pass through the openings. Coarse screen 32 conveys the briquettes, by means of a vibrating motion, toward and onto an inclined conveying plane 33 having briquette discharge lip 34. The cooled briquettes thus discharged at 35 are in condition for shipment, storage or immediate use. Residual heat in the briquettes causes evaporation of water remaining in or on the briquettes. Controlling time in the cooling bath controls such evaporation and temperature of the cooled briquettes. The temperature of the briquettes following cooling is between 60–90° C. In the preferred embodiment the briquettes are conveyed across screen 32 and up inclined conveyor plane 33 which can be solid or of the screen material. The vibrating means 36 is biased so as to impart a horizontal movement to the briquettes in a direction toward discharge lip 34. Such vibrating means can act on entire enclosure 28 and internal components or other vibrating means (not shown) attached solely to screen 32 can be used. In an embodiment wherein the entire enclosure is vibrating, a mounting means such as springs 37 can be used to mount the entire enclosure.

The fragments and fines which pass through coarse screen 32 are conveyed on deck 40 having inclined portion 42 leading to fragment discharge lip 44. Conveying on deck 40 can also be by vibrating means 36 when the entire enclosure and internal components are vibrated or by an independent vibrating means. Deck 40 and inclined portion 42 in the preferred embodiment is of a solid continuous material and inclined portion 42 forms part of enclosure 28 to contain water bath 26. Discharge lip 44 is above the surface of the bath.

Fragments discharged at 44 can be diverted by means such as movable stone box diverter 46 toward stockpiling or other use at 48 or to additional screening in a direction indicated by arrow 50. Such additional fine screening at 52 which needs to handle only a small portion of the product stream can be of relatively lightweight construction. Fragments retained on screening means 52 are removed at 54 and passed fragments exit at 56. Additional screening means for different size product can be added to the system. For continued operation of the briquetting and separation means during maintenance of fine screens 52, moveable stone box diverter 46 can be set to discharged fragments at 58.

During start-up of a direct reduced iron and hot briquetting operation, initially produced briquettes sometimes lack strength and do not stay intact through such quenching step. Such problem can be caused by the presence of oxide, deviation from preferred processing temperature or other reasons. The apparatus of the invention serves to separate such non-acceptable product as it passes screen 32 and is conveyed toward diverter 46. Such material can be directed back through the reducing process by setting the diverter to convey it in a direction indicated by arrow 48 back to the reducing process. Such "testing" of product strength is an added feature of the invention.

Quenching bath water 26 can be filtered or conveyed to a settling means to remove fines suspended in the water. Water temperature can be controlled with use of a cooling tower or heat exchanger (not shown). Such control of temperature and removal of fines are well known in the art. Filtered and cooled water can be recirculated with entry to the enclosure at 60 and exit to filtering and cooling at 62. Connection means are provided at entry and exit means to accommodate the vibrating enclosure.

While specific materials and processing steps have been set forth for purposes of describing embodiments of the invention, various modifications can be resorted to, in light of the above teachings, without departing from applicant's novel contributions; therefore in determining the scope of the invention reference shall be made to the appended claims.

What is claimed is:

1. In a process for hot briquetting of direct reduced iron, a method for separating briquettes and fragments of a product stream resulting from the process, comprising providing a cooling bath with submerged separating means disposed and sized so as to retain the briquettes and pass the fragments, quenching the product stream of briquettes and fragments in the cooling bath, then:

retaining the quench cooled briquettes on the separating means, passing the quench cooled fragments through the separating means, removing the retained quench cooled briquettes from the bath, and removing the passed quench cooled fragments from the bath separately from the quench cooled briquettes.

2. A method according to claim 1, wherein the cooling bath consists of water.

3. A method according to claim 1, wherein the means for separating comprises a screen.

4. A method according to claim 3, wherein the screen is vibrated to assist separation and to convey the quench cooled briquettes so as to remove them from the cooling bath.

5. A method according to claim 1, wherein quench cooled fragments are removed from the cooling bath by means of a vibrating deck disposed within the cooling bath and below the separating means so as to retain and convey the passed quench cooled fragments.

6. A method according to claim 4, wherein the screen comprises a substantially horizontal portion and an inclined portion for separating and conveying the quench cooled briquettes and removing them from the cooling bath.

7. A method according to claim 5, wherein the vibrating deck comprises a substantially horizontal portion and an inclined portion for conveying the quench cooled fragments and removing them from the cooling bath.

8. A method according to claim 3, wherein the screen has openings with dimensions of about 20 mm by 20 mm.

9. A method according to claim 1, wherein the briquettes and fragments are quench cooled to a temperature in the range of about 60–90° C.

10. A method according to claim 1, further comprising providing a diverter for receiving passed quench cooled fragments, and during start-up of an associated reducing process and said briquetting process, directing passed quench cooled fragments back to the associated reducing process and said briquetting process.

11. In a process for hot briquetting of direct reduced iron, a method for separating briquettes and fragments of a product stream resulting from the process, comprising providing a water cooling bath with a submerged separating screen disposed and sized so as to retain the briquettes and pass the fragments, quenching the product stream of briquettes and fragments in the water cooling bath, then:

retaining the quench cooled briquettes on the submerged screen, passing the quench cooled fragments through the screen, conveying and removing from the bath the quench cooled briquettes by vibrating the separating screen, and conveying and removing from the bath, separately from the quench cooled briquettes, the quench cooled fragments passed by the separating screen.

12. A method according to claim 11, further comprising providing a deck disposed within the bath and below the separating screen so as to retain the passed quench cooled fragments, and vibrating the deck so as to convey and remove the quench cooled fragments passed by the screen.

* * * * *